United States Patent [19]

Herrelko et al.

[11] Patent Number: 4,598,691

[45] Date of Patent: Jul. 8, 1986

[54] GAS OVEN WITH RECESSED BROIL BURNER

[75] Inventors: Edward J. Herrelko, Bethlehem; James E. Hurley; William J. Day, both of Allentown, all of Pa.

[73] Assignee: Raytheon Company, Lexington, Mass.

[21] Appl. No.: 718,623

[22] Filed: Apr. 1, 1985

[51] Int. Cl.[4] ..... F24C 3/04

[52] U.S. Cl. ..... 126/41 R; 126/21 R; 126/19 R; 126/39 C

[58] Field of Search ..... 126/19 R, 21 R, 41 R, 126/273 R, 39 C

[56] References Cited

U.S. PATENT DOCUMENTS

| | | | |
|---|---|---|---|
| 2,323,821 | 7/1943 | Lindemann et al. | 126/39 C |
| 3,090,371 | 5/1963 | Davis | 126/39 C X |
| 3,151,610 | 10/1964 | Hanson et al. | 126/41 R |
| 3,357,475 | 12/1967 | Schweitzer | 126/41 R X |
| 3,422,809 | 1/1969 | Perry | 126/21 A |
| 3,423,568 | 1/1969 | Meckley et al. | 219/279 |
| 4,240,397 | 12/1980 | Seidel | 126/21 R |

FOREIGN PATENT DOCUMENTS

| | | | |
|---|---|---|---|
| 840587 | 6/1952 | Fed. Rep. of Germany | 126/41 R |

*Primary Examiner*—Samuel Scott
*Assistant Examiner*—Allen J. Flanigan
*Attorney, Agent, or Firm*—William R. Clark; Richard M. Sharkansky

[57] ABSTRACT

A gas oven having a broil burner recessed up into a chamber above the ceiling to provide more usable space in the oven cavity. A partition closely above or extending from the sides of the burner forms an upper chamber duct which extends from an exhaust flue at the rear to a passageway to the cavity at the front of the chamber. The products of combustion from the burner flow forwardly in lateral troughs to the passageway where they mix with other cavity vapors and then rearwardly in the duct to the exhaust flue. The duct functions to reduce the body temperature of the burner to prevent flashback and also enhances stack action.

11 Claims, 9 Drawing Figures

GAS OVEN WITH RECESSED BROIL BURNER

BACKGROUND OF THE INVENTION

The general field of the invention relates to a gas oven having a broil burner.

It is common for a gas oven to have two burners. The bake burner, which has commonly been referred to as the oven burner, it typically housed in a burner box or combustion chamber located below the floor of the oven cavity. Products of combustion from the bake burner either flow directly into the oven cavity or are used to heat a baffle which provides heat to the cavity.

In the prior art, broil burners have been located within the oven cavity adjacent to the ceiling. One type of broil burner is a radiant burner such as described in U.S. Pat. No. 3,122,197, issued Feb. 25, 1964. In such a radiant burner, a gaseous fuel issues from a bottom porous surface such as a screen. The flames burn close to the screen heating it to an incandescent temperature to provide infrared radiant energy which is directed downwardly to broil food. In another type of broil burner, the bottom structure is such that the gaseous fuel issuing from ports is dispersed laterally causing a relatively wide horizontally burning flame. With either type of broil burner, however, an oven liner front wall which extends downwardly at the entrance to the cavity has been used. The function of the oven liner front wall is to provide a shield for the broil burner. If cooking utensils or food were pushed against the broil burner they could damage the burner, clog ports, or seriously interfere with the flow of the gaseous fuel and/or secondary combustion air to and around the burner. A drawback of the conventional oven liner front wall is that it significantly reduces the usable volume of the oven cavity by lowering the entrance height. This has resulted in a competitive disadvantage for gas ovens as compared to electric ovens. More specifically, a customer who wants a self-clean oven with a cavity broiler is often influenced to buy an electric oven because an equivalent gas oven has had significantly smaller usable volume.

SUMMARY OF THE INVENTION

It is an object of the invention to provide a self-cleaning gas oven that has a cavity with a usable volume that is competitive with electric self-clean ovens.

It is also an object of the invention to provide increased usable space in a gas oven having a broil burner. Also, it is an object to provide increased usable space in a self-clean gas oven.

Further, it is an object to remove the broil burner from the cavity of a gas oven while maintaining favorable flame characteristics. Also, it is an object to reduce the possibility of flashback in a broil burner that is recessed into a chamber above the oven cavity. Another object is to provide sufficient stack action in a gas oven having a relatively short flue resulting from the broil burner being recessed into a housing above the oven cavity.

These and other objects and advantages are provided by the invention which defines a gas oven comprising an oven cavity having side walls, a back wall, a floor, a ceiling with an aperture and a front door, a chamber disposed above the ceiling and communicating with the cavity through the aperture, and a gas burner substantially recessed up into the chamber. It may be preferable that the gas burner be a radiant broil burner. Also, it may be preferable that the oven further comprise a partition dividing at least a portion of the chamber into upper and lower compartments wherein the burner is positioned in the lower compartment. Also, the oven may further comprise an exhaust flue communicating with the back of the upper compartment wherein products of combustion from the burner flow forwardly in the lower compartment, upwardly into the upper compartment while mixing with vapors from the cavity and then rearwardly in the upper compartment for exhaust through the exhaust flue. The upper compartment can be considered as a duct which extends from a region adjacent to the front of the burner to the exhaust flue thereby limiting the temperature of the top of the burner while improving the stack action of the oven.

The invention may also be practiced by a gas oven comprising an oven cavity comprising side walls, a back wall, a floor, a ceiling having a recess, and a front door, a gas burner substantially positioned in the recess, an exhaust flue communicating with the back of the recess, means for providing gaseous fuel to the burner, the fuel burning upon issuing from the burner for broiling food in the cavity, and means for directing products of combustion from the burning forwardly, upwardly and then backwardly within the recess above the burner to the exhaust flue. The directing means may preferably comprise a partition in the recess above the burner defining a duct leading to the exhaust flue. Alternatively, it may be preferable that the directing means comprise substantially horizontal partitions connected to the sides of the burner wherein the products of combustion mix with vapors from the cavity before flowing backwardly along the top of the burner to limit the temperature of the top of the burner. It may be preferable that the burner be an elongated radiant burner longitudinally disposed from front-to-back in the recess, the burner having a downward-facing porous surface through which the gaseous fuel flows for burning thereby heating the porous surface to an incandescent temperature to provide infrared broiling radiation.

The invention further defines a gas oven comprising an oven cavity having side walls, a back wall, a floor, a ceiling having an aperture, and a front door, a housing located above the ceiling over the aperture wherein the housing has side panels, a rear panel, a front panel, and a top panel, a partition dividing the rear portion of the housing into an upper duct and a lower compartment, an exhaust flue communicating with the back of the upper duct, a gas burner substantially positioned within the lower compartment, means for providing a flow of gaseous fuel from the burner, the fuel burning to provide broiling of food in the cavity, and the products of combustion of the burner flowing laterally and forwardly in the lower compartment and then upwardly into the upper duct for backward flow to the exhaust flue.

The invention further defines an oven cavity comprising side walls, a back wall, a floor, a ceiling, and a front door, a chamber positioned above the ceiling and communicating with the cavity, a partition dividing the chamber into an upper duct and a lower compartment, a passageway from the lower compartment to the upper duct at the front of the chamber, a gas burner substantially recessed up into the lower compartment with the top of the burner being closely spaced to the partition and the sides of the burner being spaced from the sides of the lower compartment defining downward-facing troughs, the burner having a downwardly-facing porous surface, means for providing a flow of gaseous fuel downwardly through said porous surface, said fuel burning to heat the porous surface to an incandescent temperature for producing downwardly-directed infrared radiation for broiling, the upper duct having a rear exhaust port, and the porous surface having a longitudinal downward-extending crest for encouraging products of combustion of the burning to flow laterally into the troughs, the products of combustion then flowing forwardly and into the passageway where they mix with vapors from the cavity and then rearwardly in the upper duct to the exhaust port. The gas burner may be an elongated box-like radiant gas burner substantially disposed longitudinally from front-to-back in the lower compartment. In an alternate embodiment, longitudinal partitions may be connected from the sides of the radiant burner to the sides of the panels of the recess to define the downwardly facing troughs along the sides of the burner.

BRIEF DESCRIPTION OF THE DRAWINGS

These and other objects and advantages of the invention will be more fully understood by reading the Description of the Preferred Embodiment with reference to the drawings, wherein.

DESCRIPTION OF THE PREFERRED EMBODIMENT

Figure 1:
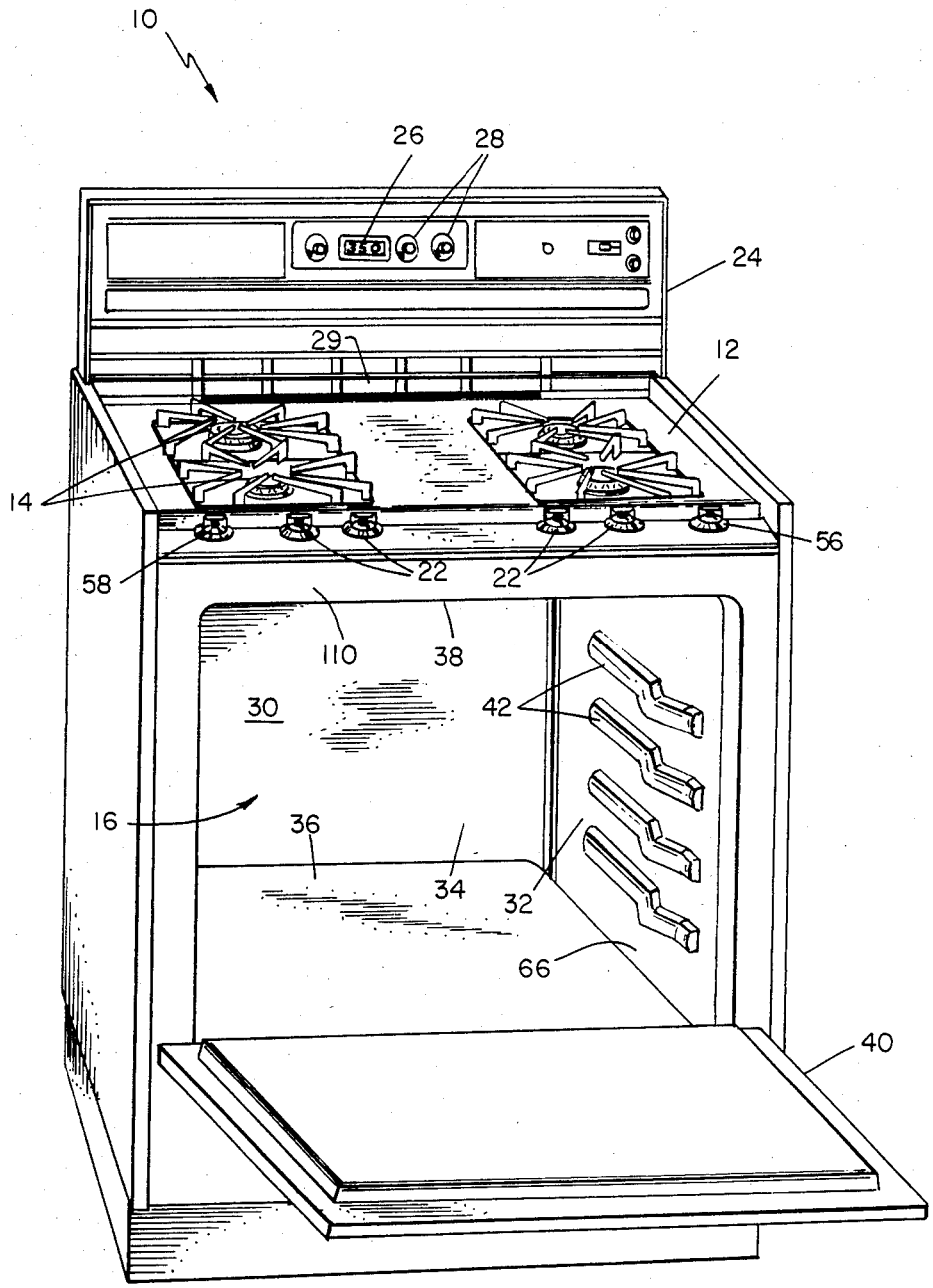
FIG. 1 is a front perspective view of a gas range.

Referring to FIG. 1, a front perspective view of gas range 10 is shown. Although it is to be understood that the invention may be used to advantage in many types of gas ovens, such as, for example, "built-in" wall ovens, gas range 10 is here depicted as a "free-standing" unit which has a cook top 12 with surface burners 14 in addition to oven 16. In conventional manner, surface burners 14 are activated by gas flowing through pipes 17 (FIG. 2) from gas manifold 18 as controlled by valves 20 connected to a row of corresponding front control knobs 22. Upstanding backsplash 24 which may include a clock 26 and associated controls 28 houses vent 29 through which vapors from oven 16 are exhausted.

Figure 2:
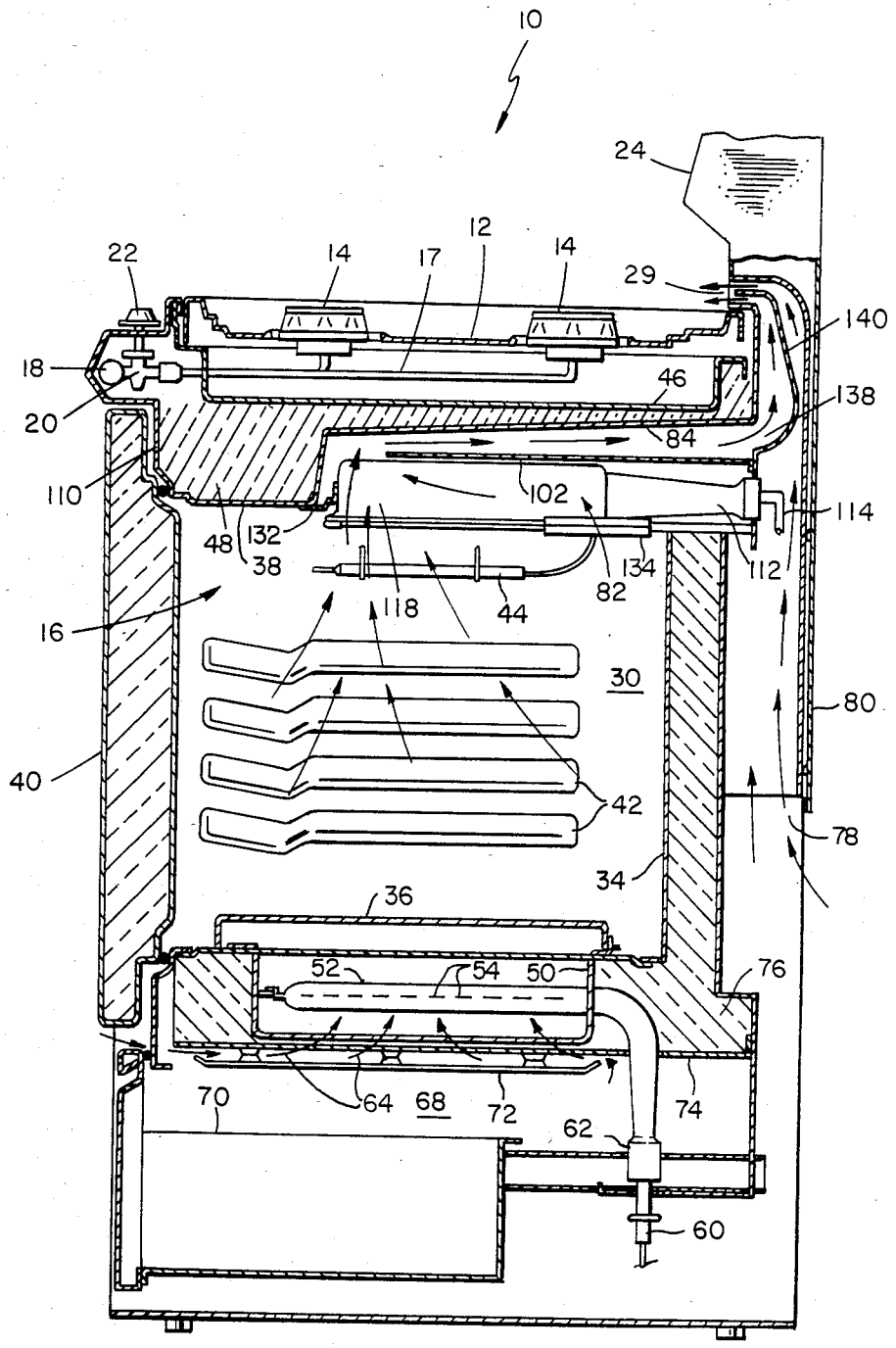
FIG. 2 is a side sectioned view of the range of FIG. 1.

Still referring to FIG. 1 and also to FIG. 2 which shows a partially broken-away side sectional elevation view of gas range 10, oven 16 includes a generally box-shaped metal liner or cavity 30 defined by side walls 32, back wall 34, floor 36, ceiling 38 and front door 40 which is hinged on its underside. Side walls 32 are contoured to form guides 42 from which oven racks (not shown) are supported. A temperature sensor 44, here shown as a thermostat bulb is mounted on one of the side walls 32. Surface burner box 46 and insulation 48 separate the surface burners 14 from oven 16. Positioned below oven floor 36 is lower burner box 50 or combustion chamber in which the oven burner or bake burner 52 is mounted. Here, bake burner 52 is shown as a front-to-back or longitudinally disposed tubular burner. For example, bake burner 52 may be a conventional blue flame burner having a horizontal row of ports 54 along each side.

The three modes of operation of oven 16 as determined by selector knob 56 are BAKE, BROIL, and SELF-CLEAN. Bake burner 52 is activated in the BAKE and SELF-CLEAN modes. Bake burner 52 is controlled by a conventional oven control system (not shown) which is responsive to selector knob 56, temperature set knob 58, and temperature sensor 44. In the BAKE mode, the oven control system energizes a pilotless igniter (not shown) and, after a predetermined delay, electrically activated valve 60 is energized so that regulated gas flows into the mixing chamber or venturi 62 with aspirated primary combustion air. The gas and primary combustion air mixture issues from the burner ports 54 where it is ignited. Secondary combustion air, here indicated by arrow 64 flows into lower burner box 50. The products of combustion from bake burner 52 flow upward into cavity 30 through openings, here shown as longitudinal gaps 66, between oven floor 36 and side walls 32. In the BAKE mode, the oven control system, in response to temperature sensor 44, cycles bake burner 52 on and off to approximately maintain the temperature of the temperature set knob 58. In the SELF-CLEAN mode, bake burner 52 is cycled on and off to maintain a predetermined selfcleaning temperature such as, for example, 950° F. The structure and operation described heretofore are conventional.

Compartment 68, which may preferably contain storage drawer 70, is separated from bake burner 52 by lower burner box 50, retainer 74, and heat shield 72. Air drawn into lower burner box 50 weaves back and forth through passages formed between these metal layers. It has been found that these metal layers provide a thermal barrier which is more effective than previously used glass insulation. Not only is heat removed from the barrier by secondary combustion air 64 drawn by burning, but heat is also removed by natural convection when bake burner 52 is cycled off. Accordingly, the build-up of heat during extended high temperature but cycled usage is not so great as with glass insulation. As a result, many temperature sensitive substances and objects which could not previously be stored below a gas oven can be stored in storage drawer 70. A retainer 74 supports insulation 76 along back wall 34 and side walls 32. A vertical conduit 78 is formed inside the rear cover plate 80.

Figure 3:
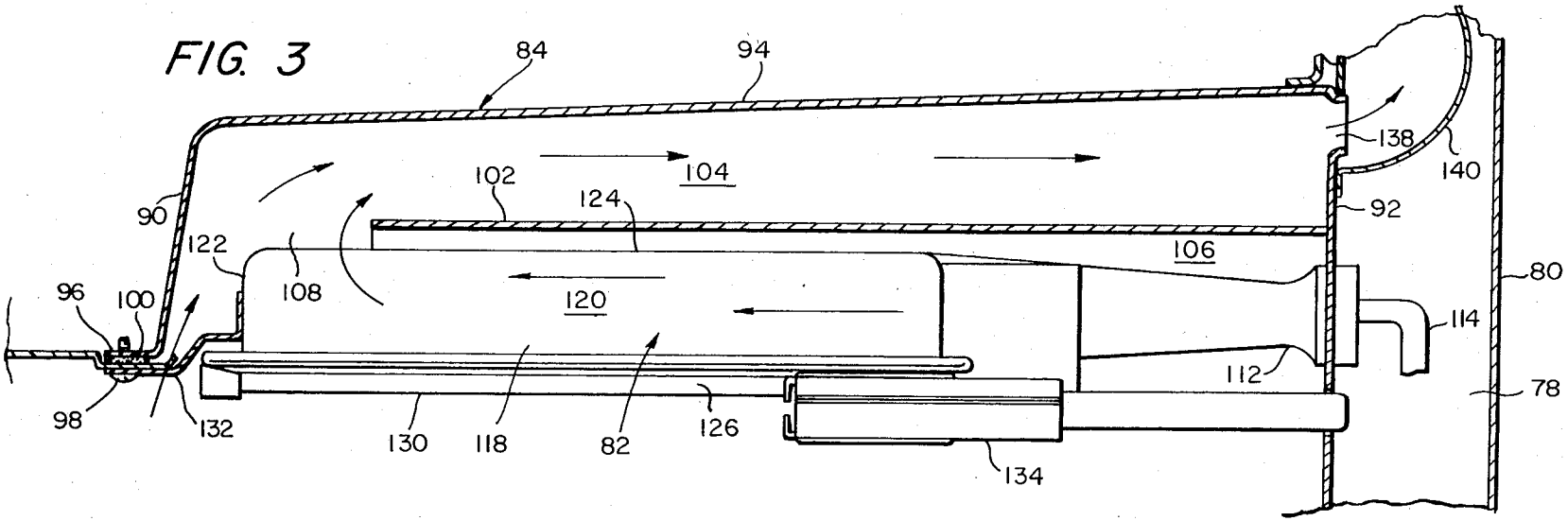
FIG. 3 is an expanded view of the broil burner chamber.
Figure 4:
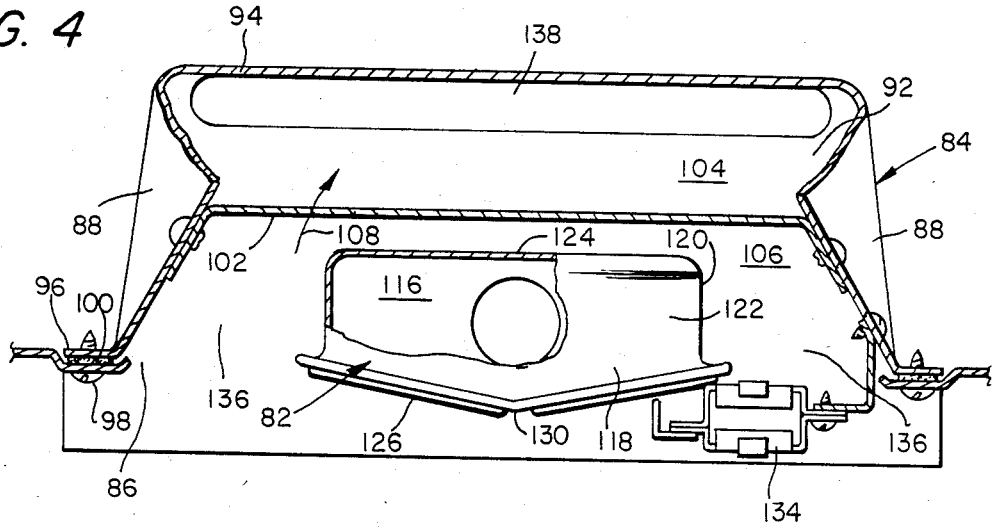
FIG. 4 is a partially broken away front sectioned view of the broil burner chamber.
Figure 5:
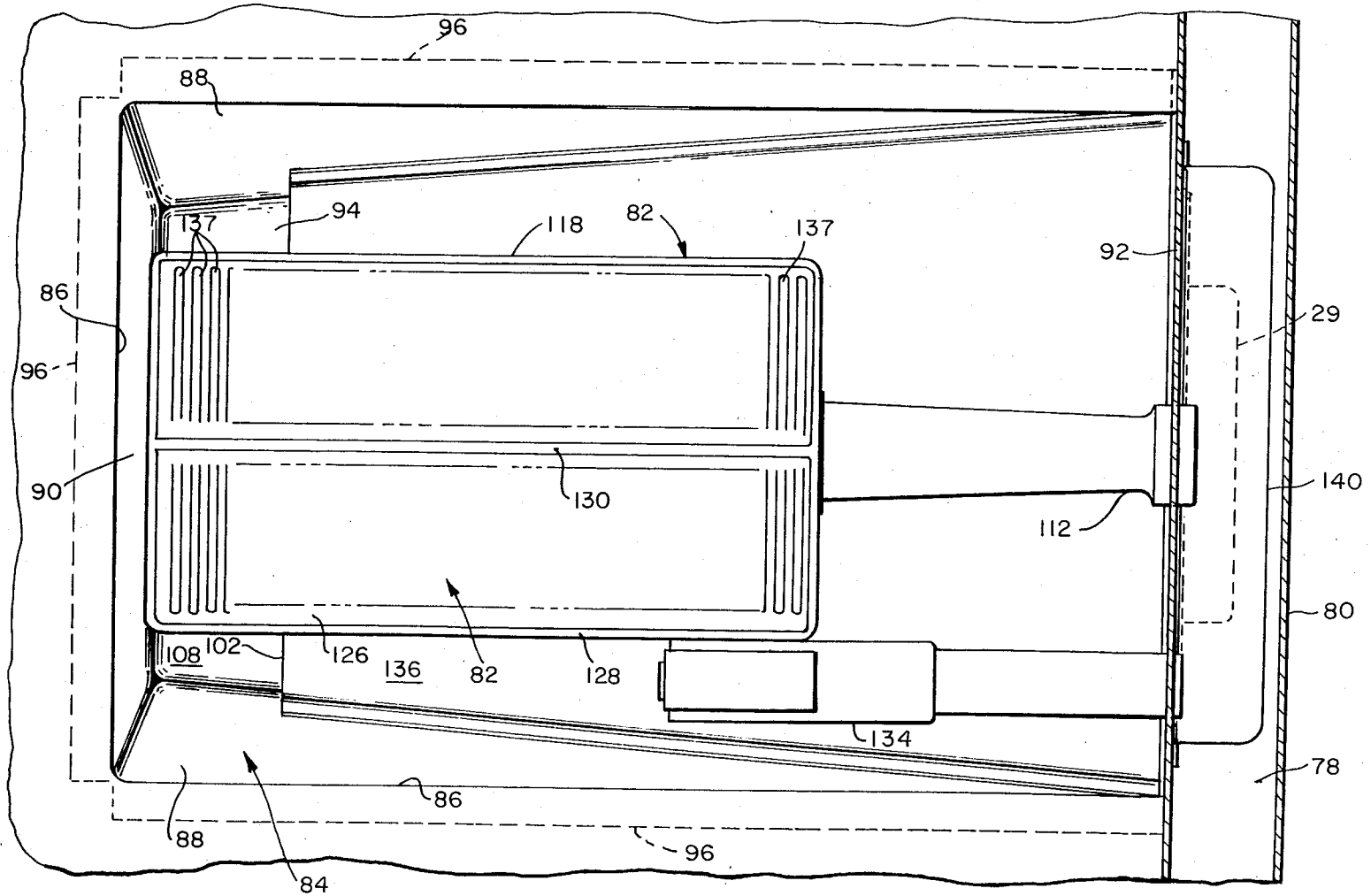
FIG. 5 is a bottom plan view of the broil burner chamber.

In accordance with the invention, a gas broil burner 82 is located substantially above the general box shape of oven cavity 30 and is recessed into a chamber or housing 84 above an aperture 86 in cavity ceiling 38. FIGS. 3, 4, and 5 respectively show expanded side sectioned, partially broken-away front sectioned, and bottom plan views of gas broil burner 82 positioned in housing 84. The size and shape of aperture 86 and correspondingly housing 84 may preferably be a function of the type of broil burner 82 being used. In one illustrative embodiment, aperture 86 is a rectangle having a front-to-back or longitudinal dimension of approximately 15.75 inches and a lateral or transverse dimension of approximately 10.5 inches. Housing 84, which defines a hood or chamber above aperture 86, is a metal casing having side panels 88, a front end panel 90, a rear end panel 92 and a top panel 94. The side panels 88 and at least the front end panel 90 have flanges 96 which are connected to the ceiling around the perimeter of aperture 86 using suitable means such as sheet screws 98 and a gasket 100. For reasons that will be understood later herein, the height and top width of front end panel 90 may preferably be smaller than the corresponding dimensions of rear end panel 92 as shown best in FIG. 4. For example, the height and top width of the rear end panel may be 3.69 inches and 10 inches, respectively, while the height and top width of front end panel 90 may be 3 inches and 6.25 inches, respectively. Horizontal partition 102 is connected to opposing side panels 88 dividing chamber or housing 84 into an upper compartment 104 or duct and a lower compartment 106. As shown best in FIG. 3, partition 102 does not extend all the way from rear end panel 92 to front end panel 90 thereby defining a passageway 108 from lower compartment 106 to upper compartment 104 at the front of housing 84. In further accordance with the invention, gas broil burner 82 is substantially recessed within lower compartment 106 such that the usable volume within oven cavity 30 is increased. It is noted that the conventional liner front wall which is normally required to prevent cooking utensils and food from contacting the broil burner is not used. More specifically, there is no downward extending plate at the front of cavity 30 at the junction between ceiling 38 and the face 110 of the door frame. For example, in earlier gas ovens, the entrance or usable height of cavity 30 may have been only 13 inches even though the height from the floor to the ceiling of the cavity may have been 16 inches. Here, however, without having the conventional liner front wall, the full 16-inch height of cavity 30 is usable.

Although other types of broil burners could be used, broil burner 82 is here shown as a radiant burner or gas burning radiant energy generator similar in construction to that described in U.S. Pat. No. 3,122,197, issued Feb. 25, 1964, which is hereby incorporated by reference. Specifically, broil burner 82, which may typically have a rating of 15,500 BTU's per hour, has a mixing throat or venturi 112 into which a flow of gaseous fuel is directed through an orifice from pipe 114 thereby aspirating primary combustion air in a suitable ratio that is relatively high. The mixture flows down the mixing throat 112 into the plenum 116 of the burner head 118 which may preferably define an elongated box-like structure longitudinally disposed in lower compartment 106. For example, burner head 118 may have sides 120 with dimensions approximately 9.5 inches by 1.5 inches, a front end 122 of approximately 4.8 inches by 1.5 inches, and a top cover 124 which is closely spaced, such as approximately 0.228 inches, from partition 102. The bottom side 126 defines a porous surface such as a screen or mesh held in place by a frame 128. Bottom side 126 has a downwardly extending longitudinal crest 130 forming dihedral surfaces that are laterally inclined. The front end 122 of burner head 118 is connected to the perimeter of aperture 86 by suitable means, here shown as mounting bracket 132. Pilotless igniter 134 is mounted adjacent to bottom side 126. Sides 120 of burner 82 are spaced from respective side panels 88 of housing 84 thereby defining downwardly facing troughs 136.

Broil burner 82 is controlled by the same oven control system that operates bake burner 52. Broil burner 82 is activated for the BROIL mode and it has also been found to be desirable that broil burner 82 be used during SELF-CLEAN mode to elevate the temperature in cavity 30 to approximately 650° F. or 750° F. at which temperature, the use of broil burner 82 is discontinued in lieu of the use of bake burner 52. More specifically, a large amount of smoke may be generated in the 475° F. to 650° F. temperature range of SELFCLEAN operation. If smoke is generated, it has been found to be desirable to exhaust it past a broil burner for incineration of the smoke particles. In the BROIL mode, the oven control system energizes igniter 134 for a predetermined time period and then an electrically controlled valve is opened to direct the gaseous fuel from pipe 114 into venturi 112. The gaseous fuel and primary combustion air mixture described earlier is introduced into plenum 116 and flows downwardly through the perforations 137 or elongated ports on the bottom side 126. Upon issuing from the bottom side 126, the mixture is initially ignited by igniter 134. The continued burning of the gaseous mixture adjacent to the bottom side 126 raises the surface of the bottom side 126 to an incandescent temperature at which substantial infrared energy is radiated downwardly towards food. In addition to advantageously dispersing the radiant energy, the lateral incline or dihedral geometry of the porous bottom side 126 encourages the products of combustion to move laterally so as to prevent smothering. It has been found that it may be preferable that the bottom side 126 of burner 82 be located slightly below the plane of ceiling 38 to optimize flame characteristics. The troughs 136 are provided to receive the products of combustion to ensure that their lateral movement away from the burning flame continues. Because top cover 124 is closely spaced to partition 102, the products of combustion do not flow in any significant amount against top cover 124 where they could cause an excessive temperature in plenum 116 possibly resulting in gas explosion or flashback. Rather, the products of combustion flow forward in troughs 136 to passageway 108. While flowing up through passageway 108 to upper duct or compartment 104, the products of combustion mix with and are cooled by other vapors from cavity 30. Then, the mixture of products of combustion and other cavity vapors flows rearwardly through duct 104 to opening 138 which communicates with inner flue 140. The top panel 94 of housing 84 is inclined upwardly in the rearward direction so as to encourage the rearward flow of vapors in duct or upper compartment 104. Optimum broiling results may be attained by cycling broil burner 82 on and off during BROIL mode.

Figure 7:
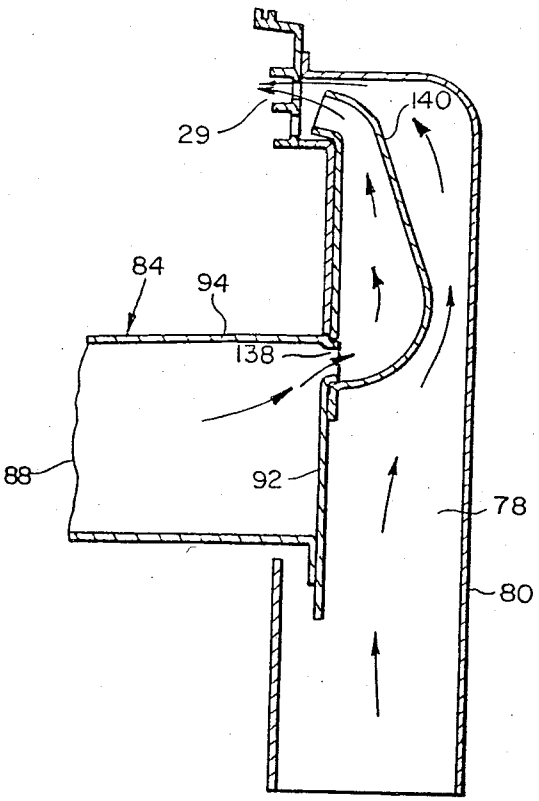
FIG. 7 is a side sectioned view of the exhaust flue.
Figure 6:
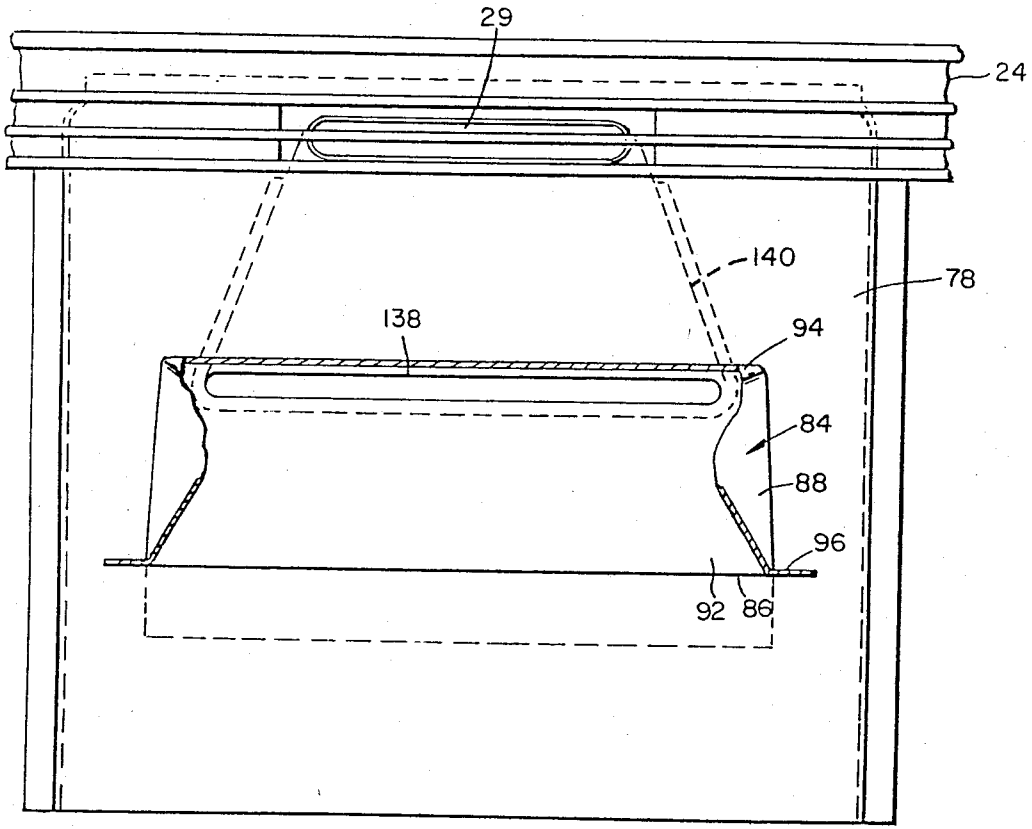
FIG. 6 is a partially broken away front view showing the exhaust flue.

Referring to FIGS. 6 and 7, front and side elevation views of inner flue 140 from exhaust vent 29 in vertical conduit 78 or dilution flue are shown. Opening 138 from duct 104 to inner flue 140 is elongated and horizontally disposed as shown best in FIG. 6. For example, opening 138 may have a width of 8.25 inches and a height of 0.688 inches. Opening 138 is relatively wide so as to couple with inner flue 140 which is wide so as to spread out and thereby enhance the heat transfer to air in vertical conduit 78. The height of opening 138 which is relatively small because of the spatial limitations of recessing broil burner 82 in housing 84 helps to increase the stack action which is important because of the relatively short length of inner flue 140. More specifically, although the flow path in duct 104 or upper compartment has only a very slight vertical incline, the reduced cross-section in duct 104 and opening 138 increases the velocity of the mixture of products of combustion and cavity vapors thereby improving stack action. Inner flue 140 may have an opening through vent 29 which is approximately 6.8 inches wide and 0.5 inches high. As shown best in FIG. 7, the trim of backsplash 24 may have a plurality of openings whereby the hot air from inner flue 140 mixes with air from vertical conduit 78 while being exhausted into the room.

Summarizing, partition 102, which divides chamber or housing 84 into a duct or upper compartment 104 and a lower compartment 106, functions to provide two advantages. First, because top cover 124 of burner head 118 is closely spaced to partition 102, flow of the products of combustion up along the sides 120 of the burner head 118 to the top cover 124 is greatly limited. More specifically, tests run without partition 102 showed that the temperature of top cover 124 during normal broiling cycles reached almost 1100° F. However, with partition 102, the temperature of top cover 124 was approximately 50° or 75° cooler thereby greatly reducing the possibility of flashback within plenum 136. Second, because the position of burner 82 is higher than ovens having the burner positioned in the cavity, the flue 140 is shorter thereby reducing the stack action. Although the flow of vapors in duct 104 as defined by partition 102 is to a large degree horizontal, the path and velocity of the vapor enhances stack action.

Figure 8:
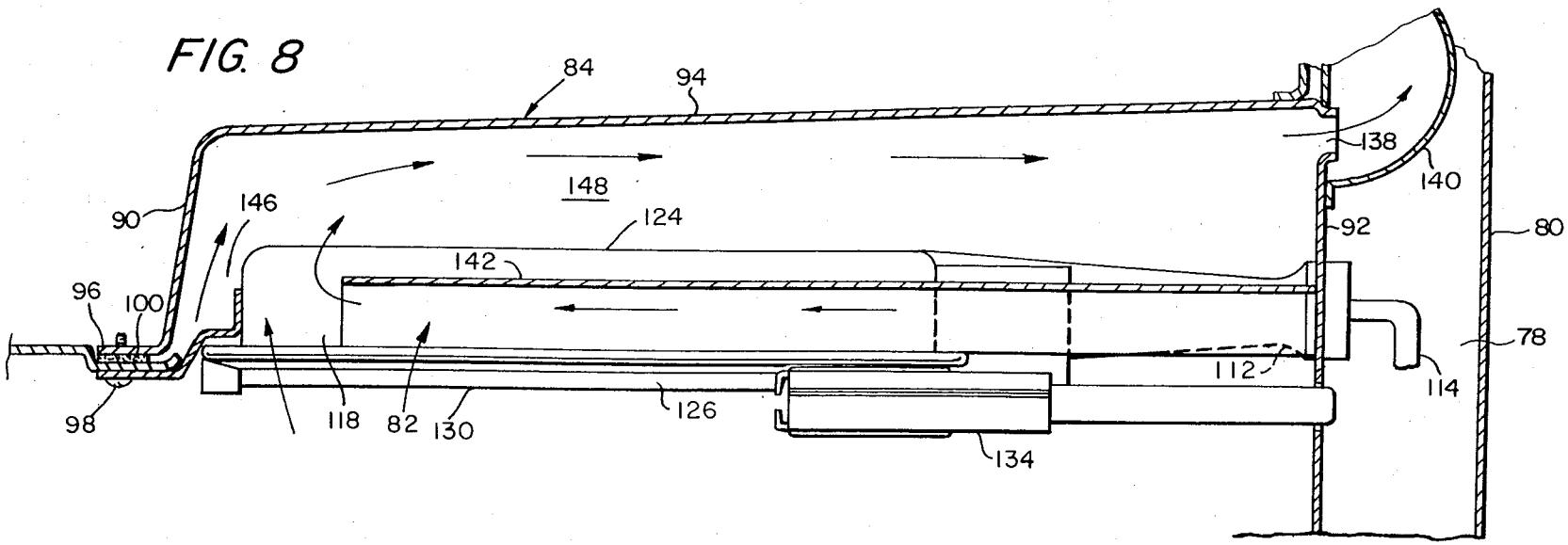
FIG. 8 is a side sectioned view of an alternate embodiment of the broil burner chamber.
Figure 9:
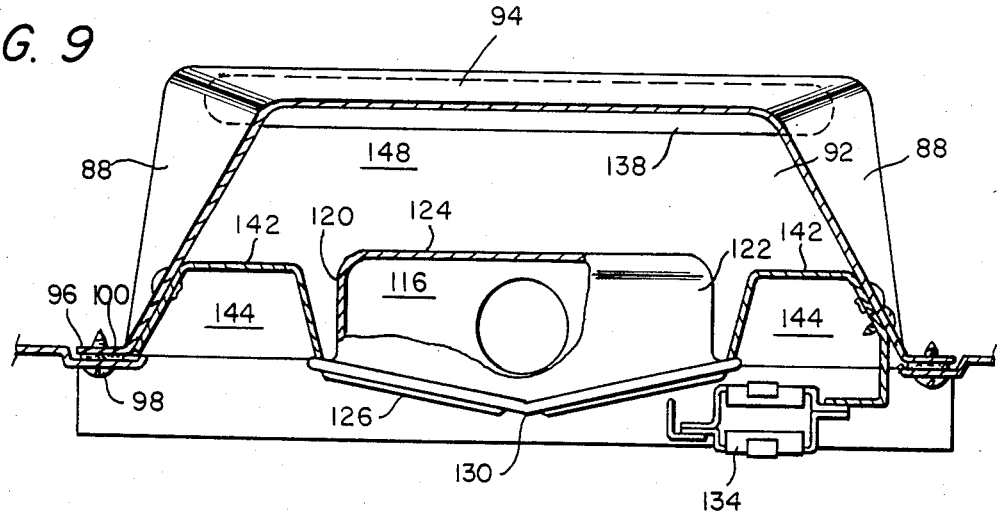
FIG. 9 is a front view of the alternate embodiment of the broil burner chamber.

Referring to FIGS. 8 and 9, side sectioned and broken-away front views of an alternate embodiment of partition 102 are shown. More specifically, instead of using a partition that spans from one side panel 88 to the other, a baffle 142 connects each side 120 of burner 82 to the adjacent side panel 88. As shown best in FIG. 9, baffles 142 have a winged shape so as to provide troughs 144 which have an identical function to troughs 136 of FIG. 4. More specifically, trough 144 receives the products of combustion from the burning adjacent to bottom side 126 and channel the products of combustion forward to passageway 146 where baffles 142 terminate in housing 84. Accordingly, baffles 142 prevent the products of combustion from wrapping up around the sides 120 to overheat top cover 134 of burner 82. The products of combustion do flow from passageway 146 back along top cover 124 to opening 138 but by then they have been cooled by mixing with other vapors of cavity 30 in passageway 146. The temperature of top cover 124 using baffles 142 is approximately the same as when using partition 102. The embodiments of FIGS. 4 and 9 function similarly with an upper duct 148 being formed by the burner 82 itself and two baffles instead of by partition 102. The temperature of cover top 124 is limited while the stack action is enhanced.

This concludes the Description of the Preferred Embodiment. A reading of it by those skilled in the art will bring to mind many modifications and alterations without departing from the spirit and scope of the invention. Accordingly, it is intended that the scope of the invention only be limited by the appended claims.

What is claimed is:

1. A gas oven comprising:

an oven cavity having side walls, a back ball, a floor, a ceiling with an aperture, and a front door;

a chamber disposed above said ceiling and communicating with said cavity through said aperture;

a partition dividing a rear portion of said chamber into upper and lower compartments, said upper and lower compartments communicating with each other solely at the front of said chamber;

a radiant gas burner substantially recessed up into said lower compartment of said chamber; and an exhaust flue communicating with the back of said upper compartment wherein products of combustion from said burner flow forwardly in said lower compartment, upwardly into said upper compartment while mixing with vapors from said cavity, and then rearwardly in said upper compartment for exhaust through said exhaust flue.

2. A gas oven comprising:

an oven cavity comprising side walls, a back wall, a floor, a ceiling having a recess, and a front door;

a radiant gas burner substantially positioned in said recess;

an exhaust flue communicating with the back of said recess;

means for providing gaseous fuel to said burner, said fuel burning upon issuing from said burner for broiling food in said cavity; and means for directing substantially all products of combustion from said burning forwardly, upwardly, and then backwardly within said recess above said burner to said exhaust flue.

3. The oven recited in claim 2 wherein said directing means comprises a partition in said recess above said burner defining a duct leading to said exhaust flue.

4. The oven recited in claim 2 wherein said directing means comprises substantially horizontal partitions connected to the sides of said burner wherein said products of combustion mix with vapors from said cavity before flowing backwardly along the top of said burner to limit the temperature of said top of said burner.

5. The oven recited in claim 2 wherein said radiant gas burner is an elongated burner longitudinally disposed from front to back in said recess, said burner having a downward facing porous surface through which said gaseous fuel flows for burning and thereby heating said porous surface to an incandescent temperature to provide infrared broiling radiation.

6. A gas oven, comprising:

an oven cavity having side walls, a back wall, a floor, a ceiling having an aperture, and a front door;

a housing located above said ceiling over said aperture, said housing having side panels, a rear panel, a front panel, and a top panel;

a partition dividing the rear portion of said housing into an upper duct and a lower compartment;

an exhaust flue communicating with the back of said upper duct;

a radiant gas burner substantially positioned within said lower compartment;

means for providing a flow of gaseous fuel from said burner, said fuel burning to provide broiling of food in said cavity; and substantially all the products of combustion of said burner flowing laterally and forwardly in said lower compartment, and then upwardly into said upper duct for backward flow to said exhaust flue.

7. An oven cavity comprising side walls, a back wall, a floor, a ceiling, and a front door;

a chamber positioned above said ceiling and communicating with said cavity;

a partition dividing said chamber into an upper duct and a lower compartment which communicate with each other solely at the front portion of said chamber;

a passageway from said lower compartment to said upper duct at the front of said chamber;

a radiant gas burner substantially recessed up into said lower compartment with the top of said burner being closely spaced to said partition and the sides of said burner being spaced from the sides of said lower compartment defining downward facing troughs, said burner having a downwardly facing porous surface;

means for providing a flow of gaseous fuel downwardly through said porous surface, said fuel burning to heat said porous surface to an incandescent temperature for producing downwardly directed infrared radiation for broiling;

said upper duct having a rear exhaust port; and said porous surface having a longitudinal downward extending crest for encouraging products of combustion of said burning to flow laterally into said troughs, said products of combustion then flowing forwardly and into said passageway where they mix with vapors from said cavity and then rearwardly in said upper duct to said exhaust port.

8. A gas oven comprising:

an oven cavity comprising side walls, a back wall, a floor, a ceiling having a recess, and a front door, said recess having side panels, a back panel, a front panel, and a top panel;

an oven burner positioned below said floor for baking in said cavity;

an elongated box-like radiant gas burner substantially disposed longitudinally from front to back in said recess, said burner having sides, ends, a top spaced from said top panel thereby defining a duct therebetween, and a bottom porous surface;

longitudinal partitions sealingly connected from said sides of said radiant burner to said side panels and said back panel of said recess thereby defining longitudinal downwardly facing troughs along said sides of said burner;

a passageway communicating from said cavity to the front of said duct;

an exhaust flue communicating with said duct through said back panel of said recess;

said porous surface having a downwardly extending crest; and means for providing a flow of gaseous fuel downwardly through said porous surface for burning to heat said porous surface to an incandescent temperature to provide infrared radiation for broiling, the products of combustion from said burning flowing laterally and upwardly into said troughs, forwardly in said troughs to said passageway where they mix with gaseous vapors from said oven cavity flowing in said passageway to said duct, and rearwardly in said duct to said exhaust flue.

9. The oven recited in claim 8 wherein said top panel of said recess inclines in a rearward direction to enhance stack action.

10. A gas oven, comprising:

an oven cavity having side walls, a back wall, a floor, a ceiling having an aperture, and a front door;

a housing above said ceiling over said aperture, said housing having side panels, a rear panel, a front panel, and a top panel;

a partition dividing said housing into an upper compartment and a lower compartment which communicate with each other solely at the front portion of said housing;

a gas burner substantially positioned within said lower compartment, said burner having sides, a front end, a rear end, a top, and a bottom porous surface, the top of said burner being closely spaced to said partition, the sides of said burner being spaced from said side panels of said housing thereby defining downwardly facing troughs on respective sides of said burner, said partition being spaced from said front panel of said housing providing a passageway communicating from said lower compartment to the front of said upper compartment;

an exhaust flue positioned behind said rear panel of said housing, said rear panel having a port communicating said upper compartment with said exhaust flue;

means for providing a flow of gaseous fuel downwardly through said porous surface of said burner, said fuel burning to heat said porous surface to an incandescent temperature to produce infrared radiation for broiling, said porous surface having a downwardly extending longitudinal crest for directing the products of combustion of said burning laterally and upwardly into said troughs, said products of combustion being channeled forward in said troughs, upward through said passageway while mixing with vapors from said cavity, rearwardly through said upper compartment and out said port into said exhaust flue.

11. The oven recited in claim 10 wherein said top panel of said housing inclines upwardly in the rearward direction.

* * * * *